US006142825A

United States Patent [19]

Shinchi

[11] Patent Number: 6,142,825

[45] Date of Patent: Nov. 7, 2000

[54] WATERPROOF CONNECTOR AND MANUFACTURING METHOD THEREOF

[75] Inventor: Akira Shinchi, Shizuoka-ken, Japan

[73] Assignee: Yazaki Corporation, Tokyo, Japan

[21] Appl. No.: 09/168,291

[22] Filed: Oct. 8, 1998

[30] Foreign Application Priority Data

Oct. 9, 1997 [JP] Japan ..... 9-277728

[51] Int. Cl.[7] ..... H01R 13/40

[52] U.S. Cl. ..... 439/587

[58] Field of Search ..... 439/587, 936; 29/877, 883

[56] References Cited

U.S. PATENT DOCUMENTS

| | | | |
|---|---|---|---|
| 3,879,239 | 4/1975 | Rager et al. | 156/73.1 |
| 4,083,902 | 4/1978 | Lofdahl | 264/420 |
| 4,969,260 | 11/1990 | Kondo et al. . | |
| 5,215,635 | 6/1993 | Stein et al. | 204/157.62 |
| 5,498,170 | 3/1996 | Tanaka | 439/271 |
| 5,569,050 | 10/1996 | Lloyd | 439/465 |

FOREIGN PATENT DOCUMENTS

| | | |
|---|---|---|
| 0299797 A2 | 7/1988 | European Pat. Off. . |
| 0546753 A1 | 12/1992 | European Pat. Off. . |
| 50-54591 | 5/1975 | Japan . |
| 2231792 | 12/1997 | United Kingdom . |
| 2321346 | 12/1997 | United Kingdom . |
| 2321347 | 1/1998 | United Kingdom . |
| 2321802 | 1/1998 | United Kingdom . |

OTHER PUBLICATIONS

Copy of United Kingdom Search Report.

*Primary Examiner*—Khiem Nguyen
*Assistant Examiner*—Brian S. Webb
*Attorney, Agent, or Firm*—Finnegan, Henderson, Farabow, Garrett & Dunner, L.L.P.

[57] ABSTRACT

The present invention relates to a waterproof electrical connector housing. Terminal members connected with electrical wires are accommodated in a terminal holding section of a connector housing. An adhesive agent is applied to the terminal holding section and a cover is placed over the adhesive agent and the terminal holding section. By subjecting the housing to ultrasonic vibrations, the adhesive agent hardens to seal the wires and terminal members from the environment. The ultrasonic vibrations and hardening of the adhesive agent also welds the cover to the connector housing.

5 Claims, 5 Drawing Sheets

WATERPROOF CONNECTOR AND MANUFACTURING METHOD THEREOF

BACKGROUND OF THE INVENTION

1. Field of the Invention

The present invention relates to, for example, a waterproof connector used as a component of an electric equipment in an automobile, and particularly to a waterproof connector which is obtained by ultrasonically vibrating to harden an adhesive agent and a manufacturing method thereof.

2. Description of the Related Art

A waterproof connector according to a first conventional example is arranged so that after an electric wire is fitted into a rubber plug, the electric wires are pressed against a terminal member to be connected therewith. Then, the terminal member with which the electric wire is connected is inserted into a connector housing, and thus the rubber plug carries out a waterproof function. However, in this arrangement, it is necessary to fit electric wires one by one into the rubber plug, so in the case of a multielectrode connector, manufacturing is complicated. Moreover, a rubber plug should be changed according to sizes of electric wires.

In addition, a waterproof connector according to a second conventional example is arranged so that the complexity as for individual electric wires is eliminated and application to the multielectrode connector is possible. A rubber plug is arranged so that a pair of half bodies are joined to each other (Japanese Utility Model Application Laid-Open No. 50-54591). A plurality of fitting grooves into which electric wires are fitted are formed on counter surfaces of the respective half bodies. After electric wires are fitted into the fitting grooves of one half body in parallel, the other half body is put over the electric wires so that the electric wires intervene between the half bodies. Then, the half bodies are pushed into a accommodating portion of the connector housing, and thus assembly is completed.

In addition, a waterproof connector according to a third conventional example is arranged from a viewpoint that the application to a multielectrode connector is made possible so that a terminal member is connected with points of plural electric wires and the terminal member is inserted into a terminal accommodating portion of a connector housing so that the plural electric wires are mounted to the connector housing. Then, an adhesive sealing agent (potting agent) is poured from a nozzle into the connector housing, it is heated in a high-temperature tank, and thus the potting agent is hardened so that the waterproof structure is obtained.

However, as for the waterproof connector according to the second conventional example, the rubber plug having a complicated structure should be manufactured, so it is expensive. Furthermore, when the rubber plug is pushed into the connector housing, it must be compressed, so workability is deteriorated. Moreover, similarly to the waterproof connector according to the first conventional example, it is also necessary to change a rubber plug every time sizes of electric wires are varied.

Meanwhile, in the waterproof connector according to the third conventional example, since potting agent is used, there arises no problems when such a rubber plug is used. However, a long time (several hours) is required for hardening the potting agent, there arises a problem that the manufacturing time becomes longer. Moreover, since the hardening of the potting agent depends on humidity, this connector has complexity that the ambient humidity should fall within a moderate range.

SUMMARY OF THE INVENTION

It is an object of the present invention to provide a waterproof connector having an arrangement such that the merit of using an adhesive sealing agent is secured and the adhesive sealing agent is hardened early, and to provide a manufacturing method of the waterproof connector.

In order to achieve the above object, a first aspect of the invention provides a waterproof connector in which an adhesive sealing agent is applied to a terminal holding section of a connector housing accommodating a terminal member connected with an electric wire, and this adhesive sealing agent is hardened by ultrasonic vibration.

The waterproof connector of this invention is waterproofed by ultrasonically vibrating the adhesive sealing agent applied to the terminal holding section. In this case, the adhesive sealing agent is hardened by a heat generated on a boundary portion between the adhesive sealing agent and the connector housing due to the ultrasonic vibration or a heat generated by ultrasonically vibrating the connector housing and the cover. Therefore, unlike natural drying, the adhesive sealing agent can be hardened earlier, and it can be hardened easily without depending on humidity.

A second aspect of the present invention provides a method of manufacturing a waterproof connector in which a terminal member connected with an electric wire is accommodated in a terminal holding section of a connector housing, and after a adhesive sealing agent is applied to the terminal holding section, the adhesive sealing agent is hardened by ultrasonic vibration.

In this manufacturing method of this invention, after the terminal member is accommodated in the terminal holding section, the adhesive sealing agent may be applied thereto, or after the adhesive sealing agent is applied to the terminal holding section, the terminal member may be accommodated therein. In any cases, the adhesive sealing agent applied to the terminal holding section can be hardened relatively quickly by a heat generated by ultrasonically vibrating the connector housing. For this reason, the manufacturing time can be shortened.

A third aspect of the present invention provides a waterproof connector in which a connector housing is composed of a main body, which has a terminal holding section including a terminal accommodating groove and its upper portion being opened, and a cover for covering the upper portion of the terminal holding section with it, and an adhesive sealing agent is applied to the terminal holding section and/or the cover with a terminal member connected with electric wire being accommodated in the terminal accommodating groove, and the adhesive sealing agent is hardened and the terminal holding section is welded to the cover by ultrasonically vibrating the outside of the connector housing.

In the waterproof connector of this invention, the adhesive sealing agent is applied to the terminal holding section and/or the cover with the terminal member being accommodated in the terminal accommodating groove in the main body of the connector housing, and the outside of the connector housing is ultrasonically vibrated with the cover covering the main body. Due to this ultrasonic vibration, a heat is generated on the main body of the connector housing and the cover, and thus the main body is welded to the cover relatively quickly. Moreover, the adhesive sealing agent is hardened relatively quickly by the heat at the time of the welding to become a waterproof material. For this reason, the assembly of the connector housing and the hardening of the adhesive sealing agent are carried out by the ultrasonic vibration, and thus the waterproof connector is manufactured easily. Here, the adhesive sealing agent may be applied to the terminal holding section or the cover, or to both of them, so in any cases, the connector is waterproofed satisfactorily.

According to a preferred embodiment, the terminal holding section has an electric wire arrangement groove which communicates with the terminal accommodating groove and for the electric wires to be arranged therein, and the adhesive sealing agent may be applied to the electric wire arrangement groove and/or the cover.

In this invention, since the adhesive sealing agent is applied to the electric wire arrangement groove in which the electric wire is arranged and is hardened, the circumference of the electric wire can be waterproofed securely.

According to more preferable embodiment, plural rows of the terminal accommodating grooves and the electric wire arrangement grooves may be formed.

In this invention, since plural rows of the terminal accommodating grooves and the electric wire arrangement grooves are formed, a multielectrode connector can be realized. Also in this case, the welding of the cover to the main body and the hardening of the adhesive sealing agent are carried out by the ultrasonic vibration, the connector can be manufactured easily.

A fourth aspect of the present invention provides a method of manufacturing a waterproof connector including the steps of accommodating a terminal member connected with an electric wire in a terminal accommodating groove in a main body of a connector housing, applying a gel-type adhesive sealing agent to a terminal holding section of the main body in which the terminal accommodating groove is formed and/or a cover for covering the terminal holding section with it, covering the terminal holding section with the cover, and ultrasonically vibrating an outside of the connector housing to harden the adhesive sealing agent and to weld the terminal holding section to the cover.

In this invention, after the accommodating step of accommodating the terminal member in the terminal accommodating groove, the applying step of applying the adhesive sealing agent is performed, and after the terminal holding section is covered with the cover, the vibrating step of ultrasonically vibrating is performed. For this reason, the cover is welded to the main body relatively quickly, and the adhesive sealing agent can be hardened relatively quickly. Therefore, the connector can be manufactured and the connector can be waterproofed simply and relatively quickly.

According to more preferable embodiment, the applying can be performed before the accommodating.

In such a manner, when the applying the adhesive sealing agent is performed before accommodating the terminal member, the waterproofing characteristic can be given to the connector and the connector can be manufactured simply for a short time.

BRIEF DESCRIPTION OF THE DRAWINGS

FIG. 5A is a longitudinal section view; and FIG. 5B is a cross-sectional view.

FIG. 7A is a perspective view when the adhesive sealing agent is poured into; and FIG. 7B is a perspective view after the adhesive sealing agent is hardened.

DETAILED DESCRIPTION OF THE PREFERRED EMBODIMENTS

Figure 1:
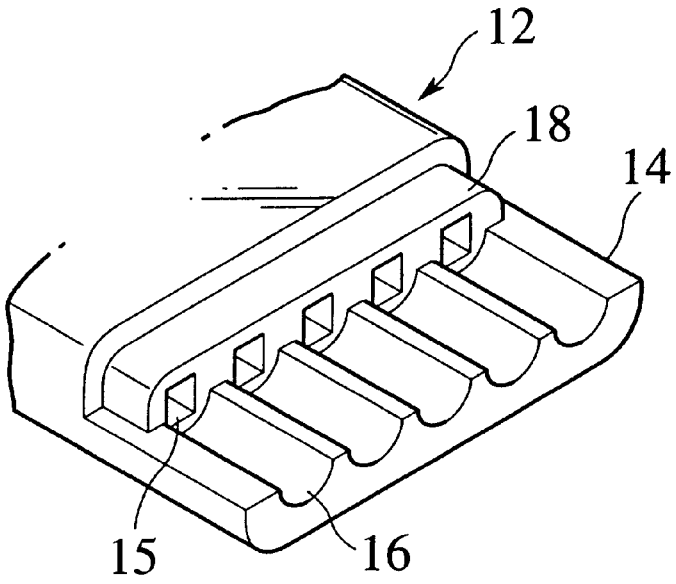
FIG. 1 is a perspective view showing a main body of a connector housing used for a waterproof connector according to one embodiment of the present invention.
Figure 2:
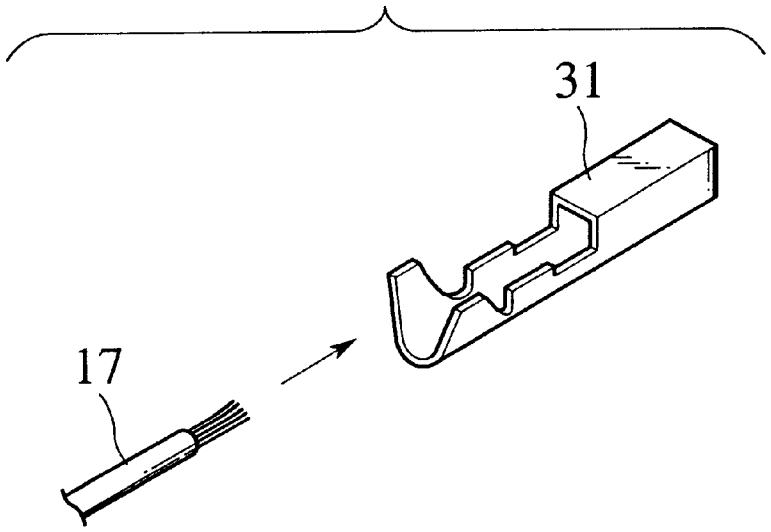
FIG. 2 is a perspective view showing an electric wire and a terminal member to be connected therewith.
Figure 3:
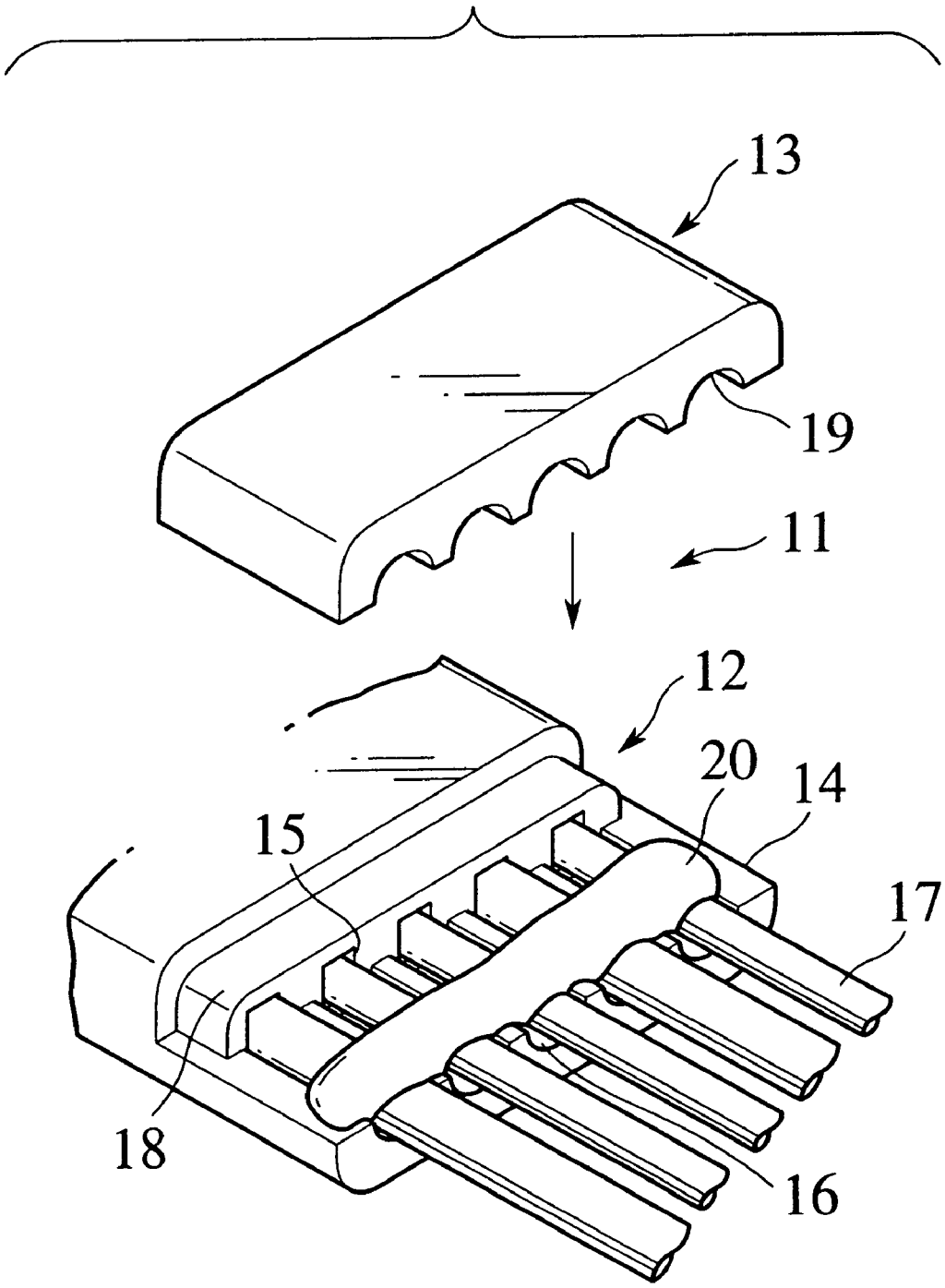
FIG. 3 is a perspective view showing a state that an adhesive sealing agent is applied.

FIGS. 1 to 3 show a connector housing 11 used for a waterproof connector according to an embodiment of the present invention. The connector housing 11 is composed of a main body 12 shown in FIG. 1 and a cover 13 shown in FIG. 3.

A board-shaped terminal holding section 14 is formed integrally on an end of one side of the main body 12. The terminal holding section 14 has a plurality of terminal accommodating grooves 15 communicating with a terminal accommodating chamber (not shown) in the main body 12 laterally, and has a plurality of electric wire arrangement grooves 16 communicating with the respective terminal grooves 15. Terminal members 31 (see FIG. 2) are inserted and accommodated into the terminal accommodating grooves 15. The terminal accommodating grooves 15 have a rectangular shape which is fitted for an external shape of the terminal members 31. The electric wires 17 are arranged in the electric wire arrangement grooves 16. The electric wire arrangemet grooves 16 have a curved shape which is fitted for an external shape of the electric wires 17.

An upper portion of the terminal holding section 14 is opened. The opened upper portion is sealed by covering it with a cover 13. Moreover, a cover supporting section 18 is formed integrally on upper portions of the terminal accommodating grooves 15 on the terminal holding section 14. An upper surface portion of the cover supporting section 18 is lower than the main body 12 like steps, and a width of its right and left side surface portion is smaller than that of the main body 12. As a result, when the terminal holding section 14 is covered with the cover 13, the cover supporting section 18 is fitted into the cover 13, and thus the cover 13 is prevented from being shifted sideways.

The cover 13 is formed so as to cover the whole terminal holding section 14. Moreover, a plurality of electric wire arrangement grooves 19 which are paired with the electric wire arrangement grooves 16 of the terminal holding section 14 are formed on a lower surface of the cover 13 which faces the terminal holding section 14. Therefore, when the terminal holding section 14 is covered with the cover 13, the electric wires 17 are surrounded by the paired electric wire arrangement grooves 16 and 19. As a result, the adjacent electric wires 17 can be prevented from contacting with each other.

The following will describe a sequence of manufacturing the waterproof connector by using the connector housing 11.

In the main body 12 in the state shown in FIG. 1, the terminal members 31 connected with the electric wires 17 are accommodated in the terminal accommodating grooves 15 respectively. Accordingly, the electric wires 17 connected with the terminal members 31 are arranged laterally in the respective electric wire arrangement grooves 16 of the terminal holding section 14.

After the electric wires 17 are arranged therein, as shown in FIG. 3, a gel-type adhesive sealing agent 20 is applied to the terminal holding section 14. The adhesive sealing agent 20 can be applied to the terminal holding section 14 by dropping, application, pouring or the like. The adhesive sealing agent 20 crosses from the upper surface on one side of the terminal holding section 14 to the electric wires 17 and the electric wire arrangement grooves 16, and is applied up to an upper surface on the other side of the terminal holding section 14. As a result, the adhesive sealing agent 20 covers all the electric wires 17.

As the adhesive sealing agent 20, a silicon-type adhesive sealing agent (product name: "TSE 399" made by Toshiba Silicone Co., Ltd.), which is dealcoholized by catalytic action so as to be condensed and hardened, is used. Moreover, as the adhesive sealing agent 20, any adhesive sealing agent may be used as long as its hardening reaction is activated by a heat, so adhesive sealing agent, which is hardened by dehydration condensation, dehydration polymerization or addition reaction, or other adhesive sealing agent are used. After such adhesive sealing agent 20 is applied, the terminal holding section 14 is covered with the cover 13 so that the upper portion of the terminal holding section 14 is sealed. The electric wire arrangement grooves 16 and 19 which face each other are covered with the cover 13 to surround the electric wires 17. After the terminal holding section 14 is covered with the cover 13, an outside of the connector housing 11 is ultrasonically vibrated.

Figure 4:
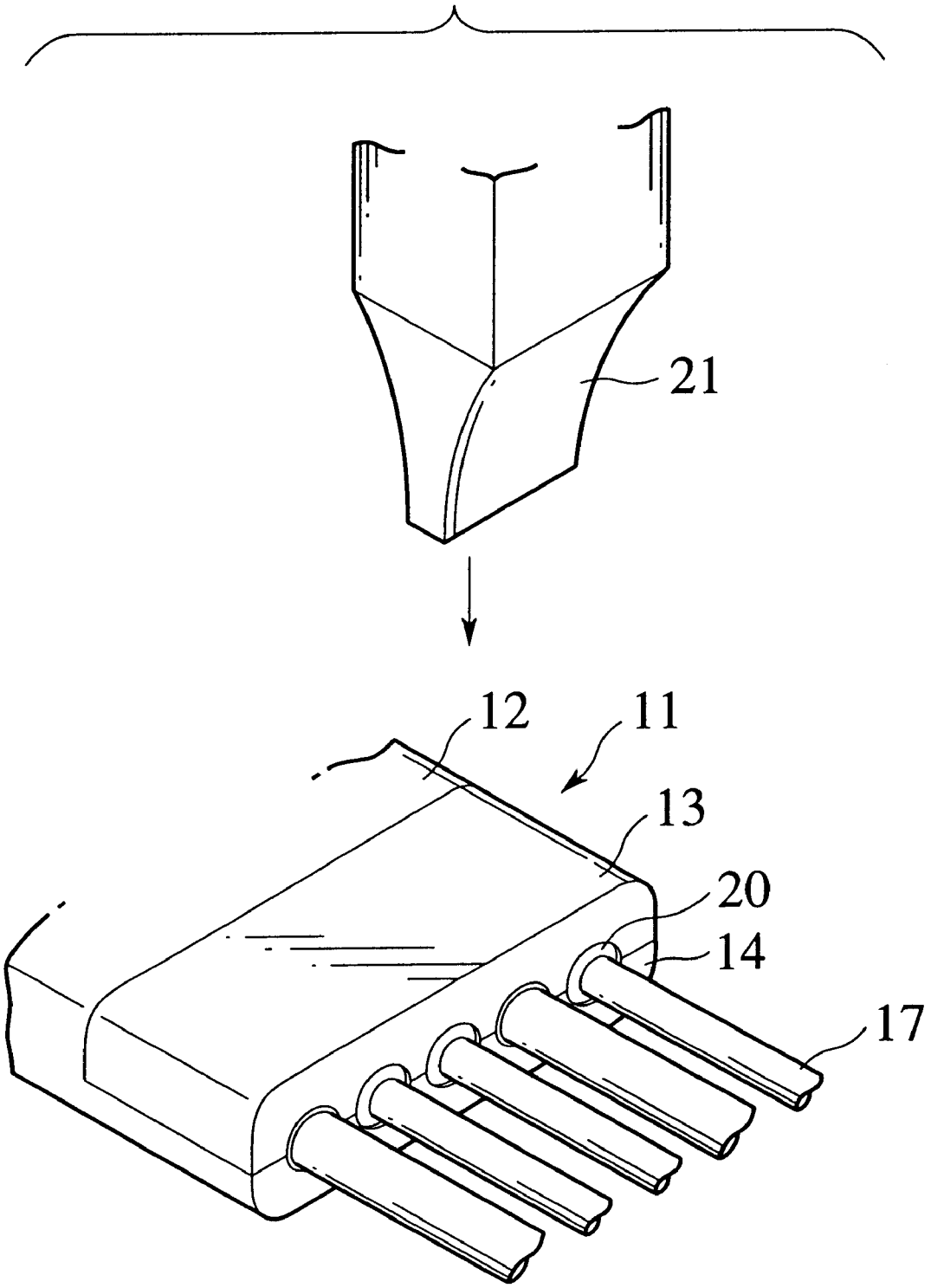
FIG. 4 is a perspective view showing a state that ultrasonic vibration is carried out.

FIG. 4 shows steps of ultrasonic vibration. A point of an ultrasonic horn 21 is brought into contact with the cover 13 so that the cover 13 is ultrasonically vibrated. The ultrasonic vibration welds the cover 13 to the portion of the terminal holding section 14 where the electric wire arrangement grooves 16 are formed, and the terminal holding section 14 is joined to the cover 13.

Figure 5A:
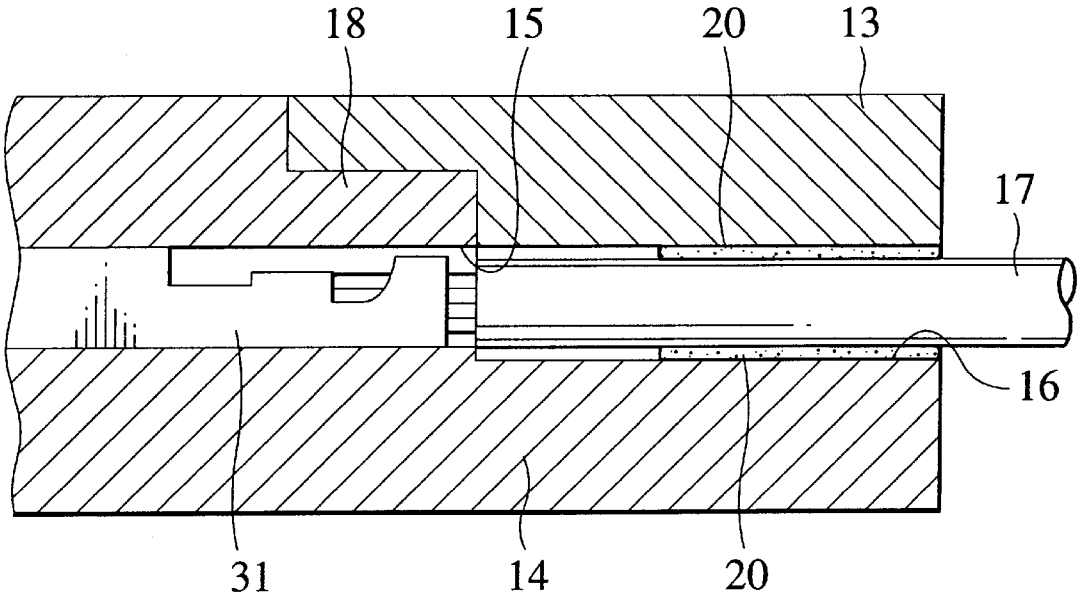
FIGS. 5A and 5B show a waterproof connector.
Figure 5B:
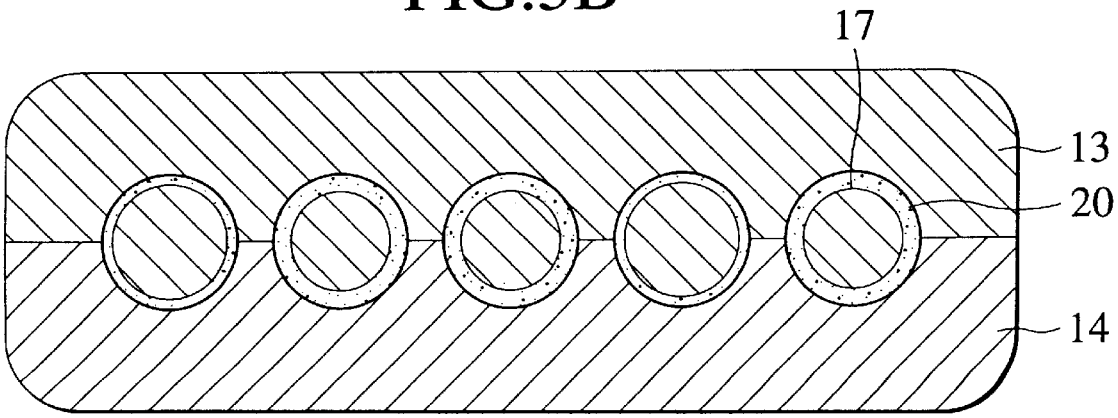

FIGS. 5A and 5B show sectional views of waterproof connector. In addition, the adhesive sealing agent 20 goes to the lower surface of the electric wires 17 causes and a gap between the electric wires 17 and the terminal holding section 14 due to the ultrasonic vibration. For this reason, the adhesive sealing agent 20 spreads around the electric wires 17 without leaving gaps, so the connector can be waterproofed firmly. Furthermore, due to the heat generated when the terminal holding section 14 is welded to the cover 13, the hardening reaction of the adhesive sealing agent 20 is activated. For this reason, the adhesive sealing agent 20 is hardened relative quickly to become a waterproof material.

Figure 6:
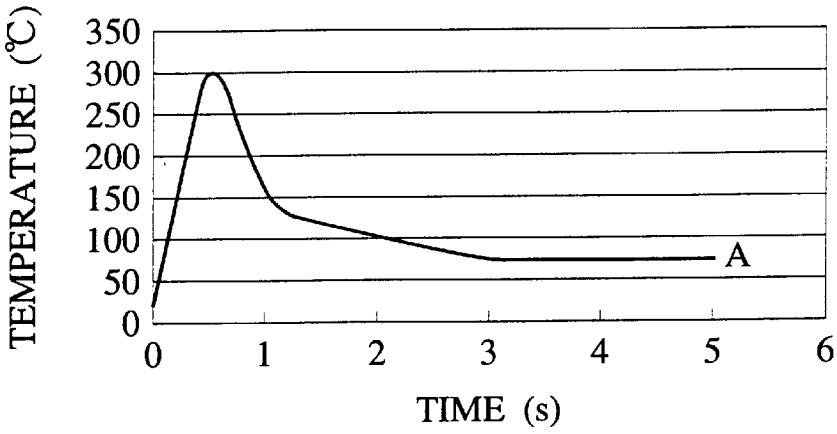
FIG. 6 is a characteristic graph showing hardening of the adhesive sealing agent.

FIG. 6 shows a change in temperature in the connector housing 11 due to the ultrasonic vibration. In the drawing, the temperature in the connector housing 11 reaches 300° C. within 1 sec by the ultrasonic vibration, and thereafter it is cooled naturally and gradually. For this reason, just when the adhesion of the cover 13 to the terminal holding section 14 is completed, the surface of the adhesive sealing agent 20 is dried sufficiently, and some adhesive force which appears several hours later at normal temperature can be obtained, so the sequence can proceed to the next step immediately.

Therefore, compared with conventional methods, since the adhesive sealing agent 20 can be dried and hardened earlier, the working time can be shortened, and the workability is improved. Namely, in the case where applied adhesive sealing agent is hardened by natural drying in the conventional methods, just when the surface of the adhesive sealing agent 20 is dried and loses its adhesive force, it takes several minutes to several dozen minutes to proceed the next step. For this reason, the working time becomes longer, and it disturbs the works.

In addition, as for the heating of the adhesive sealing agent 20 according to the present embodiment, when the terminal holding section 14 is welded to the cover 13, a necessary portion is locally heated by the ultrasonic vibration, and thus a temperature of this portion rises. For this reason, the temperature of the whole connector housing 11 is not raised widely.

As a result, compared with the conventional methods, a deformation and the like of the connector housing 11 is prevented. Namely, in order to dry the applied adhesive sealing agent, it is considered that the connector housing 11 is allowed to stand in a high-temperature tank, a light beam is emitted to the connector housing 11, high frequency wave is applied thereto so that the connector housing is dielectric-heated, and hot air is blown onto the connector housing. However, in any cases, the whole connector housing 11 is heated widely, and thus unnecessary portion is also heated, so there might arise a problem such that the connector housing 11 is deformed. Moreover, in the case where the connector housing 11 is allowed to stand in the high-temperature tank, the connector housing 11 should be taken in and out the high-temperature tank with the long electric wires being attached to the connector housing 11. Therefore, this process is complicated, and the workability is deteriorated.

In this embodiment, since it is not necessary to use a rubber plug, the cost can be inexpensive and also the workability is improved. Further, the assembly can be carried out even when sizes of the electric wires 17 are varied. Moreover, even a multielectrode waterproof connector can be manufactured easily.

In particular, in this embodiment, since the assembly of the connector housing 11 and the hardening of the adhesive sealing agent 20 are carried out by the ultrasonic vibration, the waterproof connector is manufactured easily for a short time. Further, since the adhesive sealing agent 20 spreads over every corner by the ultrasonic vibration, the connector can be waterproofed securely.

In this embodiment, after the electric wires 17 are arranged, the adhesive sealing agent 20 is applied to the electric wires 17, but the adhesive sealing agent 20 may be applied before the electric wires 17 are arranged. The adhesive sealing agent 20 may be applied to the terminal holding section 14 before the arrangement of the electric wires 17, or it may be applied to the cover 13. Moreover, in another way, the adhesive sealing agent 20 may be applied to both the terminal holding section 14 and cover 13.

Figure 7A:
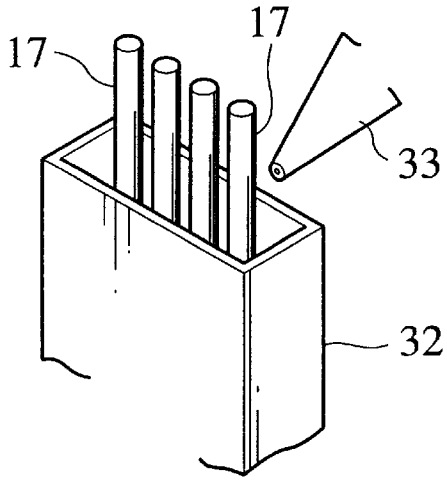
FIGS. 7A and 7B show another waterproof connector.
Figure 7B:
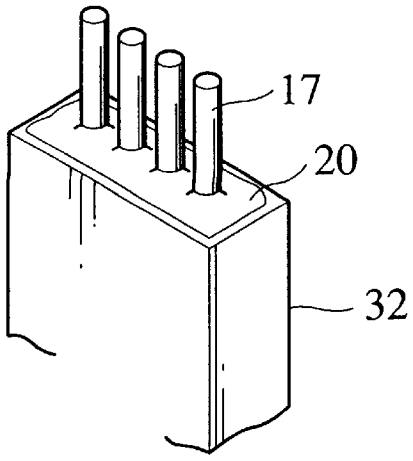

Further, the present invention can be applied to a connector housing without the cover 13 similarly. Namely, a box-shaped connector housing 32 shown in FIGS. 7A and 7B is used, and the electric wires 17 are placed on the terminal holding section in the connector housing 32. Thereafter, the adhesive sealing agent 20 is applied thereto by a nozzle 33, and the outside of the connector housing 32 is ultrasonically vibrated. This produces the same effect too.

In addition, in the present invention, instead of the multielectrode waterproof connector, a single electrode waterproof connector can be used similarly.

As mentioned above, according to the present embodiment, the adhesive sealing agent 20 applied to the terminal holding section 14 is heated to a higher temperature for a short time by a heat generated by the ultrasonic vibration, and it is hardened earlier, so it can be hardened simply without depending on humidity.

Furthermore, the adhesive sealing agent 20 applied to the terminal holding section 14 can be hardened for a short time by the heat generated by the ultrasonic vibration, and thus the manufacturing time is shortened.

In addition, since the welding of the cover 13 to the main body 12 and the hardening of the adhesive sealing agent 20 are carried out by the heat generated by the ultrasonic vibration, the assembly of the connector housing 11 and the hardening of the adhesive sealing agent 20 are carried out at the same time, so the waterproof connector can be manufactured easily.

Further, since the adhesive sealing agent 20 is applied to the electric wire arrangement grooves 16 arrangement the electric wires 17 and is hardened, the circumference of the electric wires 17 are waterproofed securely.

In addition, after the accommodating step of accommodating the terminal members in the terminal accommodating grooves 15, the applying step of applying the adhesive sealing agents 20 thereto is performed, and after the cover 13 is put thereon, the ultrasonically vibrating step is performed. For this reason, the cover 13 is welded to the main body 12 for a short time, and the adhesive sealing agent 20 is hardened for a short time.

What is claimed is:

1. A method of manufacturing a waterproof connector, comprising the steps of:

accommodating a terminal member connected to an electric wire in a terminal accommodating groove defined by a main body of a connector housing;

applying an adhesive agent to one of a terminal holding section formed by the terminal accommodating groove in the main body and a cover for covering the terminal holding section;

placing the cover on the terminal holding section after applying said adhesive agent; and ultrasonically vibrating the outside of the connector housing to thermally set the adhesive agent and to weld the terminal holding section to the cover.

2. The method of manufacturing a waterproof connector according to claim 1, wherein the applying of the adhesive agent is performed before the accommodating.

3. A waterproof connector, comprising:

a terminal member connected to an electric wire;

a connector housing having a terminal holding section, the terminal holding section including:

a terminal accommodating groove for accommodating the terminal member; and an upper portion being opened; and a cover configured to cover the upper portion of the terminal holding section; and an adhesive agent applied to one of the terminal holding section and the cover while the terminal member is accommodated in the terminal accommodating groove, wherein the adhesive agent is thermally set and the terminal holding section is configured to be welded to the cover by ultrasonically vibrating the outside of the connector housing.

4. The waterproof connector according to claim 3, wherein the terminal holding section has an electric wire arrangement groove communicating with the terminal accommodating groove, the electric wire arrangement groove for the electric wire to be arranged therein, and the adhesive agent is applied to one of the electric wire arrangement groove and the cover.

5. The waterproof connector according to claim 3, wherein a plurality of the terminal accommodating grooves and a plurality of electric wire arrangement grooves are formed.

* * * * *